US008366335B2

(12) United States Patent
Colquitt et al.

(10) Patent No.: US 8,366,335 B2
(45) Date of Patent: Feb. 5, 2013

(54) PLATEN ROLLER ASSEMBLIES FOR PRINTER AND METHODS OF REMOVAL THEREFROM

(75) Inventors: Steven Colquitt, Belleview, FL (US); Chris Christensen, Orlando, FL (US)

(73) Assignee: Datamax-O'Neil Corporation, Orlando, FL (US)

( * ) Notice: Subject to any disclaimer, the term of this patent is extended or adjusted under 35 U.S.C. 154(b) by 288 days.

(21) Appl. No.: 12/753,398

(22) Filed: Apr. 2, 2010

(65) Prior Publication Data

US 2010/0319561 A1 Dec. 23, 2010

Related U.S. Application Data

(60) Provisional application No. 61/187,892, filed on Jun. 17, 2009.

(51) Int. Cl.
*B41J 11/00* (2006.01)

(52) U.S. Cl. ..... 400/660.1; 400/651; 400/660.3; 400/692; 347/220

(58) Field of Classification Search ..... 400/648, 400/649, 650, 651, 659, 660, 660.1, 660.3, 400/692; 347/220, 222
See application file for complete search history.

(56) References Cited

U.S. PATENT DOCUMENTS

| | | | | |
|---|---|---|---|---|
| 4,611,216 | A * | 9/1986 | Ishikawa et al. | 347/81 |
| 4,697,941 | A * | 10/1987 | Takenoya et al. | 400/185 |
| 4,812,063 | A * | 3/1989 | Kunimitsu et al. | 400/234 |
| 5,927,875 | A * | 7/1999 | Lau et al. | 400/234 |
| 6,616,362 | B2 * | 9/2003 | Bouverie et al. | 400/692 |
| 7,699,550 | B2 * | 4/2010 | Bouverie et al. | 400/234 |
| 2002/0021350 | A1 * | 2/2002 | Nishimura | 347/218 |

* cited by examiner

*Primary Examiner* — Ren Yan
(74) *Attorney, Agent, or Firm* — Carter, DeLuca, Farrell & Schmidt, LLP

(57) ABSTRACT

A platen roller assembly for a printer includes a platen roller, a retaining clip, a plurality of bearings, and a pulley assembly. The platen roller defines a longitudinal axis. The retaining clip mounts to a support body of the printer and is positioned to retain the platen roller relative to the support body. The plurality of bearings are operably coupled to the platen roller. Each of the bearings permit rotational movement of the platen roller about the longitudinal axis thereof. The pulley assembly is mounted to the support body and is operably associated with one or more of the bearings. The pulley assembly includes a pulley and a belt. The belt is operably coupled to the pulley such that the platen roller rotates in response to rotational movement of the belt. The platen roller may be selectively coupled and uncoupled to/from the support body independent of the pulley assembly.

16 Claims, 21 Drawing Sheets

–PRIOR ART–

--PRIOR ART--

--PRIOR ART--

--PRIOR ART--

--PRIOR ART--

--PRIOR ART--

--PRIOR ART--

--PRIOR ART--

--PRIOR ART--

--PRIOR ART--

--PRIOR ART--

--PRIOR ART--

Fig. 16
--PRIOR ART--
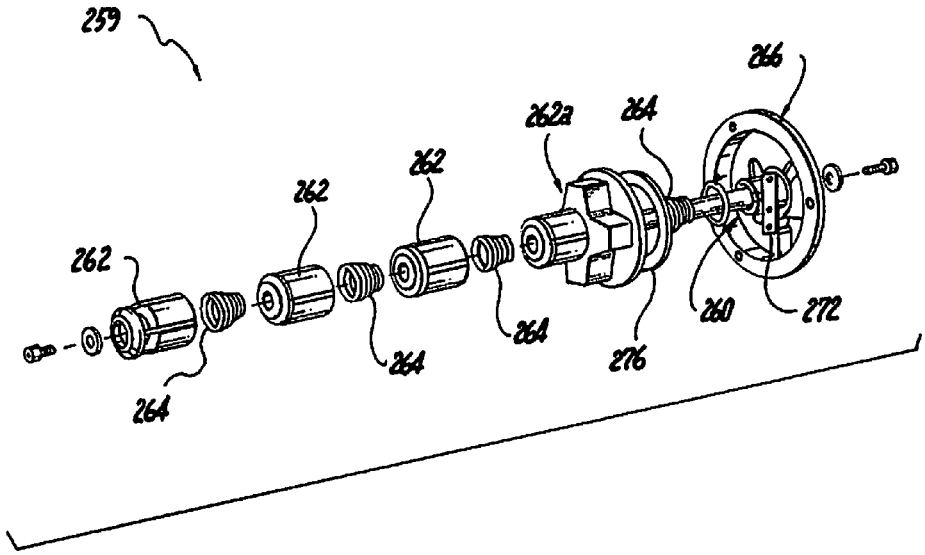
--PRIOR ART--
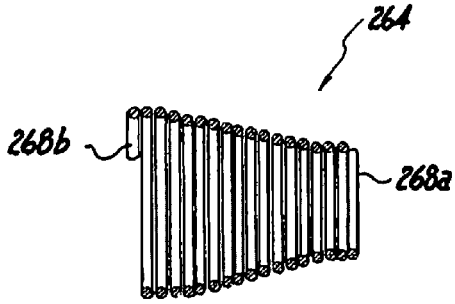
Fig. 17

PLATEN ROLLER ASSEMBLIES FOR PRINTER AND METHODS OF REMOVAL THEREFROM

CROSS-REFERENCE TO RELATED APPLICATIONS

The present application claims the benefit of and priority to U.S. Provisional Patent Application Ser. No. 61/187,892, filed Jun. 17, 2009, the entire contents of which are incorporated herein by this reference.

BACKGROUND

1. Technical Field

The present disclosure relates to printers in general and, more particularly, to platen roller assemblies for use with printers.

2. Description of Related Art

Printers have many components operating together to provide an effective drive system which often includes a belt drive. These components may include rollers, pulleys, belts, gears, bearings, etc. In the course of normal wear and tear, many of these components begin to fail or lose efficiency. In particular, some of these components, e.g., a platen roller, are susceptible to high wear and tear and must be readjusted, repaired, or even replaced quite often. Accessing some of these components can be quite cumbersome and time consuming where down-time is critical. For example, accessing the belt drive will often require removing multiple components and readjustment of belt tensioners. The most ideal circumstances require minimal effort and time to get these systems in proper working order. Therefore, repair efficiency would be improved significantly when drive components can be readjusted, repaired, or replaced without the unnecessary burden of accessing or tensioning belt drives.

SUMMARY

Accordingly, the present disclosure is directed to a printer including a platen roller assembly. The platen roller assembly includes a platen roller, a retaining clip, a plurality of bearings, and a pulley assembly. The platen roller defines a longitudinal axis. The platen roller may be selectively coupled and uncoupled to/from the support body independent of the pulley assembly. The retaining clip mounts to a support body of the printer and is positioned to retain the platen roller relative to the support body. The retaining clip is mounted to the support body via one or more screws. The plurality of bearings is operably coupled to the platen roller. Each of the bearings permits rotational movement of the platen roller about the longitudinal axis thereof. The pulley assembly is mounted to the support body and is operably associated with one or more of the bearings.

The pulley assembly includes a pulley and a belt. The belt is operably coupled to the pulley such that the platen roller rotates in response to rotational movement of the belt. One or more of the plurality of bearings and the pulley assembly are operably associated with a mounting bracket that mounts the one or more bearings of the plurality of bearings and the pulley assembly to the support body of the printer independent of the platen roller. One or more of the bearings includes a raised ring that operably couples to one or more recesses defined within the pulley. In embodiments, the raised ring may extend between about 0.070 inches to about 0.120 inches from the surface of the one or more bearings. A gasket may be disposed in mechanical cooperation with one or more of the bearings and the pulley. A D-shaped extension extends from the platen roller and operably couples with a D-cut channel defined through the pulley. The platen roller includes one or more shoulders formed to mechanically cooperate with one or more bearings.

In embodiments, the platen roller is disposed in mechanical cooperation with an extension that operably couples to the pulley assembly. The platen roller and the extension may include complimentary mating surfaces. The platen roller may define a notch. The extension may include a pin extending therefrom. The pin and the notch operably couple such that the platen roller is removably and lockingly engaged with the extension.

In one aspect, a method for removing a platen roller from a printer includes providing a printer including a support body and a platen roller assembly mounted to the support body, the platen roller assembly comprising a platen roller, a retaining clip, and a pulley assembly having a belt and pulley. The method includes removing the retaining clip from the support body. The method further includes removing the platen roller from the support body independent of the pulley assembly such that the belt and pulley remain mounted to the support body with the belt remaining operably tensioned to the pulley after the platen roller has been removed from the support body. The method may involve providing an extension that operably couples to the platen roller and the pulley assembly. The method may involve removing the platen roller from the support body such that the extension remains operably coupled to the pulley and support body.

BRIEF DESCRIPTION OF THE DRAWINGS

The above and other aspects and features of the present disclosure will become more apparent in light of the following detailed description when taken in conjunction with the accompanying drawings in which:

FIG. 16 is a side perspective view, with parts separated, of the hub assembly of the ribbon supply assembly;

FIG. 17 is a side cross-sectional view of a torsion spring of the hub assembly shown in FIG. 16;

DETAILED DESCRIPTION OF EMBODIMENTS

Figure 1:
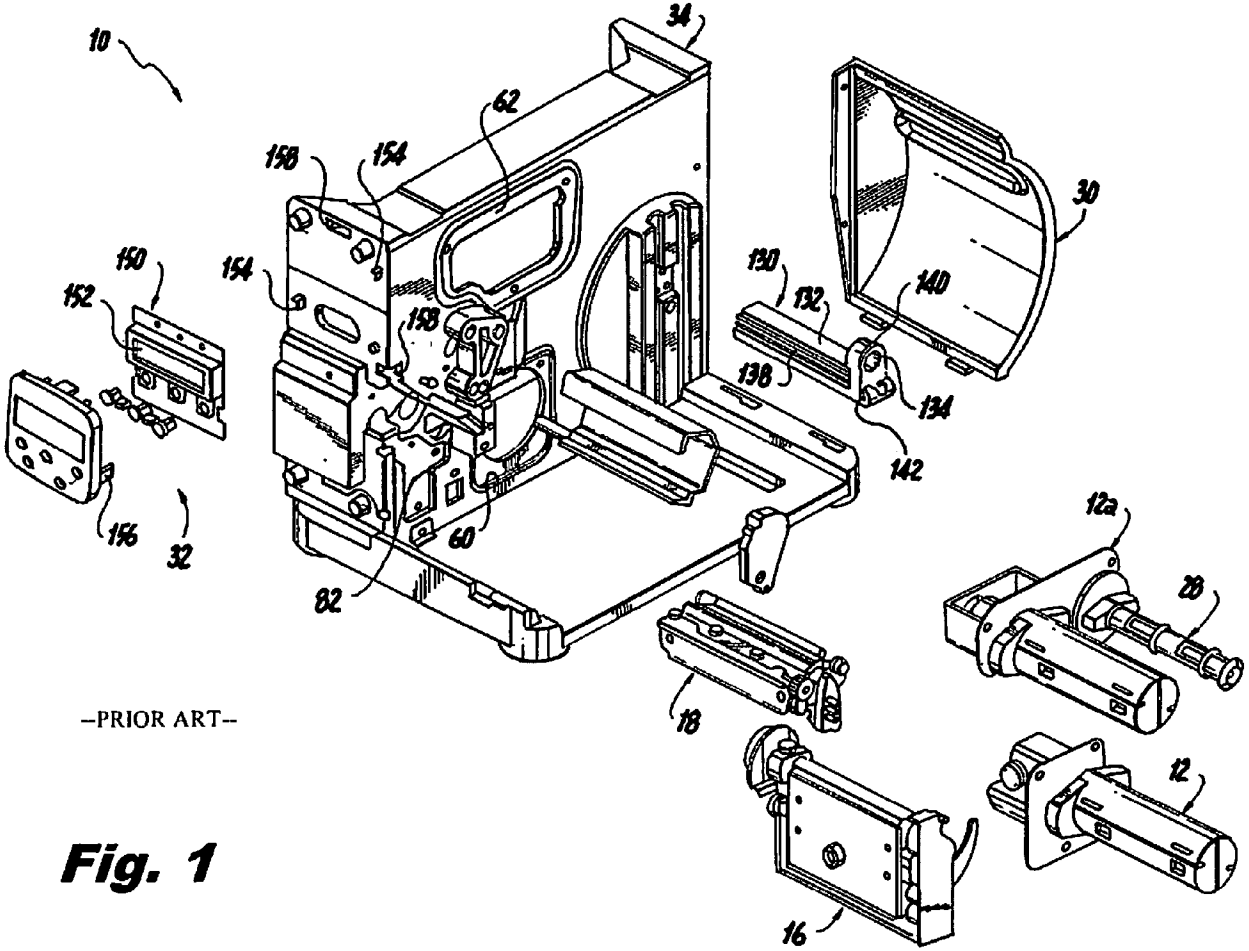
FIG. 1 is a perspective view, with parts separated, of one embodiment of the presently disclosed modular printer.

Particular embodiments of the present disclosure will be described herein with reference to the accompanying drawings. As shown in the drawings and as described throughout the following description, and as is traditional when referring to relative positioning on an object, the term "proximal" refers to the end of the apparatus that is closer to the user and the term "distal" refers to the end of the apparatus that is farther from the user. In the following description, well-known functions or constructions are not described in detail to avoid obscuring the present disclosure in unnecessary detail.

Figure 2:
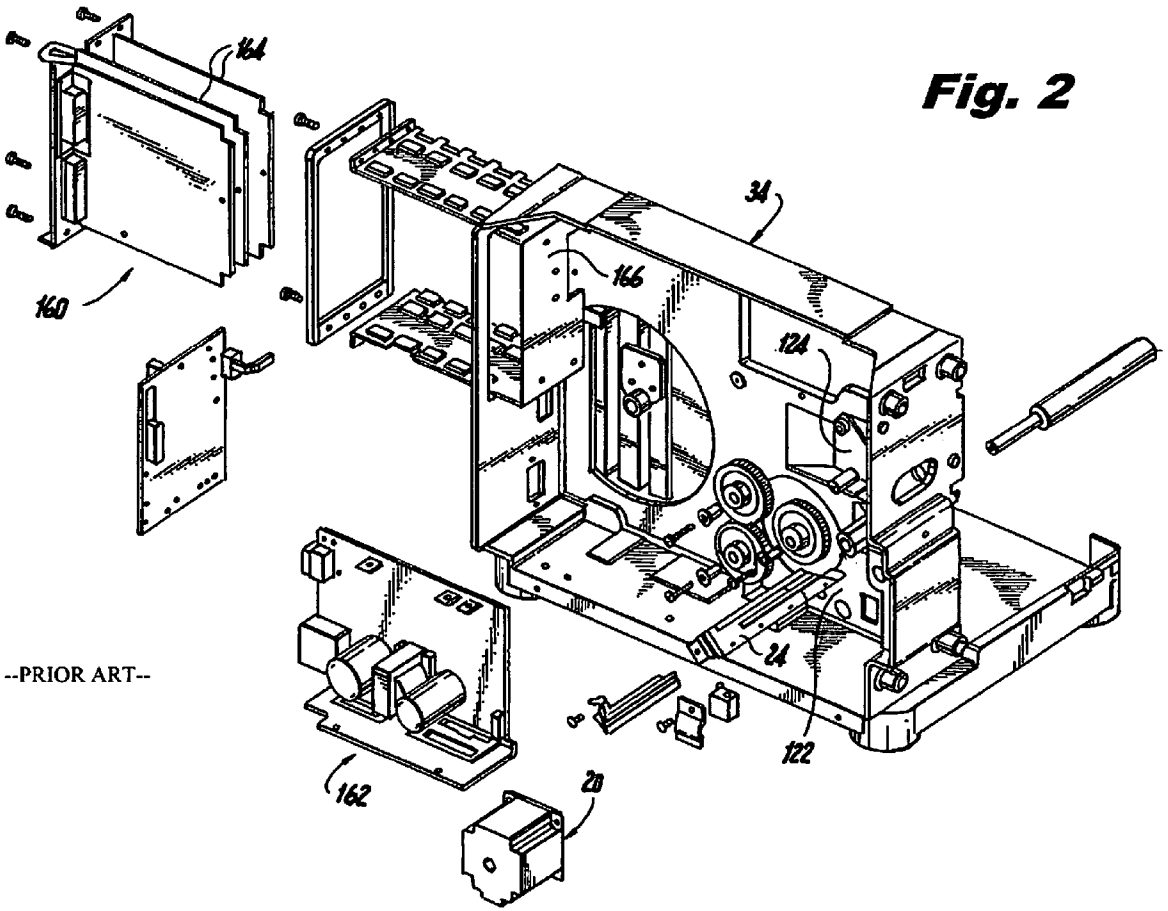
FIG. 2 is a perspective view, with parts separated, of the electrical and drive components of the modular printer shown in FIG. 1.

FIGS. 1 and 2 illustrate perspective views of a printer, with parts separated, shown generally as 10. More specifically, FIG. 1 illustrates the printing components of the printer and FIG. 2 illustrates the electrical and drive components of the printer. An example of such a printer is disclosed in U.S. patent Ser. No. 11/491,798, filed Jul. 24, 2006, now U.S. Pat. No. 7,600,684, which is currently assigned to Datamax Corporation, the entire contents of which are hereby incorporated by reference. Another example of a printer is disclosed in U.S. patent Ser. No. 11/210,535, filed Aug. 24, 2005, which is currently assigned to Datamax Corporation, the entire contents of which are also hereby incorporated by reference.

Briefly, as shown in FIGS. 1 and 2, printer 10 includes a media take-up assembly 12 including a hub assembly 14 configured to support a media take-up roll (not shown), a support block assembly 16, a printhead assembly 18, a stepper motor assembly 20, a media sensor assembly 24, a cover assembly 30 and a display assembly 32. When printer 10 is operated as a ribbon ink printer, a ribbon spool take-up assembly 28 may also be provided in conjunction with the media take-up assembly 12. Each of the above-identified assemblies is removably supported on a support housing 34. The support housing 34 defines an internal support wall of the printer and is configured for properly aligning each of the assemblies with respect to each of the other assemblies within the printer.

As discussed above, printer 10 has a display assembly 32. With reference to FIG. 1, display assembly 32 includes a module 150 having an LED display and a casing 152. Module 150 is positioned between diametrically opposed guide brackets 154 formed on support housing 34. Opposite corners of module 150 are subsequently secured to support housing 34 by screws. Casing 152 includes a plurality of flexible brackets 156 which can be snap fit to support housing 34 over module 150. Support housing 34 includes receiving structure 158 formed therein. Alternately, other known fastening devices may be used to secure module 150 and casing 152 to support housing 34.

Referring again to FIG. 2, the electrical and drive components of the printer 10 are secured to the opposite side of support housing 34. Stepper motor assembly 20 is secured to support housing 34 on the side opposite the printing components. Electronic circuitry 160 and electric drive assembly 162 to operate ink printer are secured to the support housing 34 on the side opposite the printing components. Electronic circuitry 160 is in the form of circuit boards 164, which can be installed in printer 10 by sliding the circuit boards through an opening 166, formed in support housing 34. The circuit boards can be chosen to suit the particular printing operation to be performed.

Figure 3:
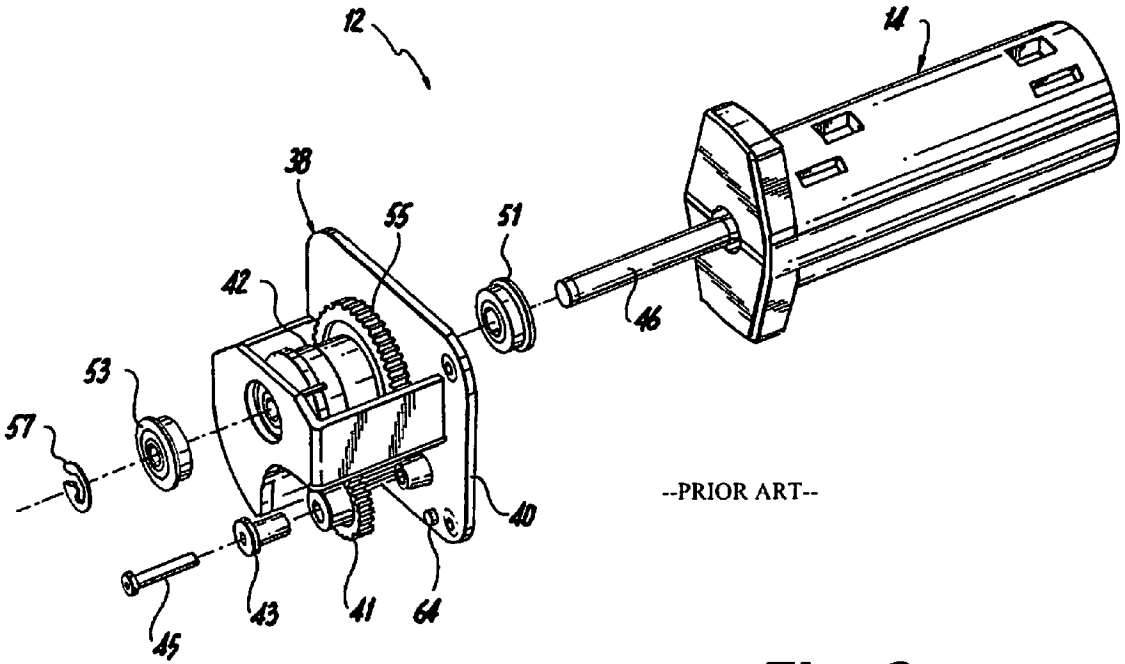
FIG. 3 is a perspective view, with parts separated, of the media take-up assembly of the modular printer shown in FIG. 1 when the printer is operated as a thermal ink printer.

Referring to FIG. 3, where printer 10 operated as a thermal ink printer, media take-up assembly 12 includes hub assembly 14, a housing 38 having a base plate 40 and a media clutch assembly 42 supported within housing 38. Media take-up assembly 12 also includes a gear 41, a post idler 43, and a screw 45 for securing gear 41 and post idler 43 to housing 38. Hub shaft 46 is supported by bearings 51 and 53. Bearing 51 is supported in driven gear 55 and bearing 53 is supported by housing 38. A lock ring 57 secures bearings 51 and 53, gear 55 and media clutch assembly 42 to hub shaft 46.

Figure 4:
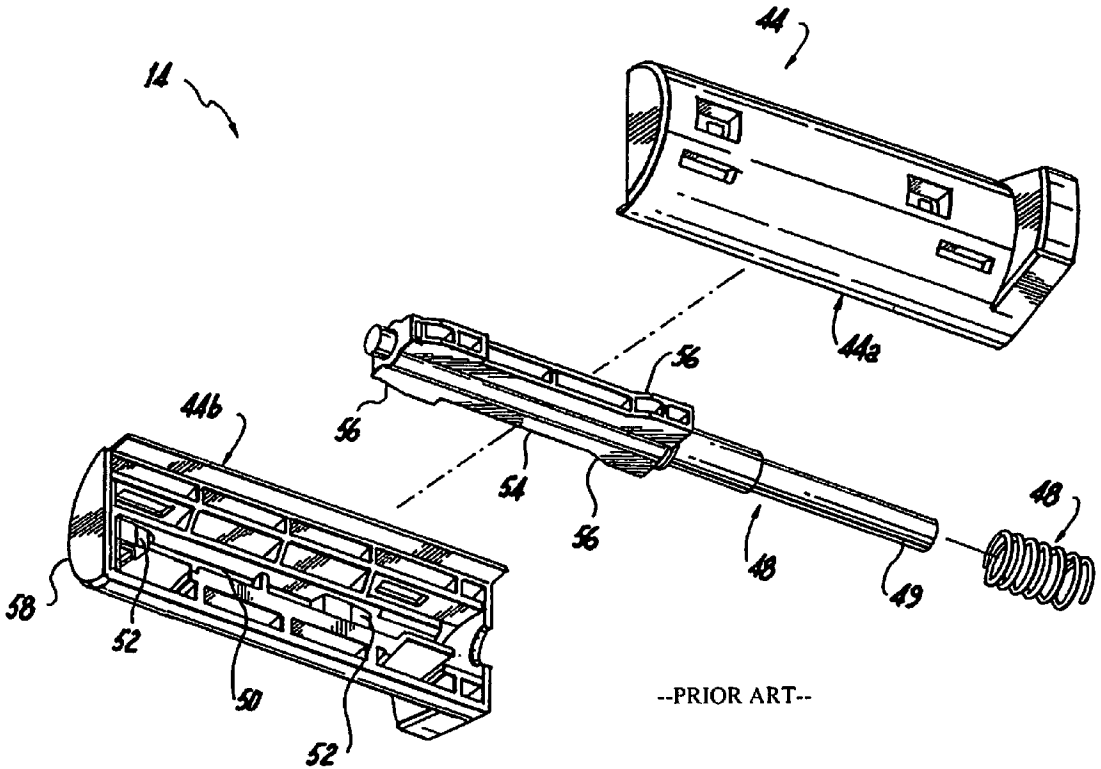
FIG. 4 is a perspective view, with parts separated, of the hub assembly of the media take-up assembly shown in FIG. 3.

Referring also to FIG. 4, hub assembly 14 includes a pair of molded housing half-sections 44*a* and 44*b*, which define hub assembly housing 44, hub shaft 46 and biasing member, e.g., a coil spring 48. Hub shaft 46 includes a first end 49 having a reduced diameter, which extends outwardly from hub assembly housing 44.

Hub assembly housing half-sections 44*a* and 44*b* define a channel 50 having a pair of cam surfaces 52 formed therein. An engagement member 54 is secured to or formed monolithically with hub shaft 46. Each side of engagement member 54 includes a pair of abutment surfaces 56. Alternately, abutment surfaces may only be provided on one side of engagement member 54.

In the assembled state, engagement member 54 of hub shaft 46 is slidably positioned within channel 50 with coil spring 48 urging hub shaft 46 towards the distal end 58 of housing 44. Abutment surfaces 56 are positioned adjacent but distal of respective cam surfaces 52. When it is desired to remove a media take-up roll from and/or position a media take-up roll onto hub assembly 14, housing half-sections 44*a* and 44*b* are pulled outward to force cam surfaces 52 into engagement with abutment surfaces 56. Because surfaces 52 and 56 are angled towards distal end 58, compression of the housing half-sections urges hub shaft 46 against the bias of spring 48 away from distal end 58 of housing 44 allowing housing half-sections 44*a* and 44*b* to move towards each other to facilitate installation or removal of a media take-up roll onto or from hub assembly 14.

Referring again to FIGS. 1 and 3, the entire media take-up assembly 12 including hub assembly 14, housing 38 and media clutch assembly 42 forms an integral unit or module.

Support housing 34 includes a plurality of reliefs formed on an internal wall of modular printer 10. One such relief 60 is configured to receive baseplate 40 of housing 38 and includes an alignment port 62 formed therein dimensioned to receive an alignment protrusion 64 formed on baseplate 40 to ensure proper positioning of media take-up assembly 12 on support housing 34. Only three screws are required to secure the entire media take-up assembly 12 to support housing 34, thus the entire assembly or module can be easily removed from or installed within printer 10.

Figure 5:
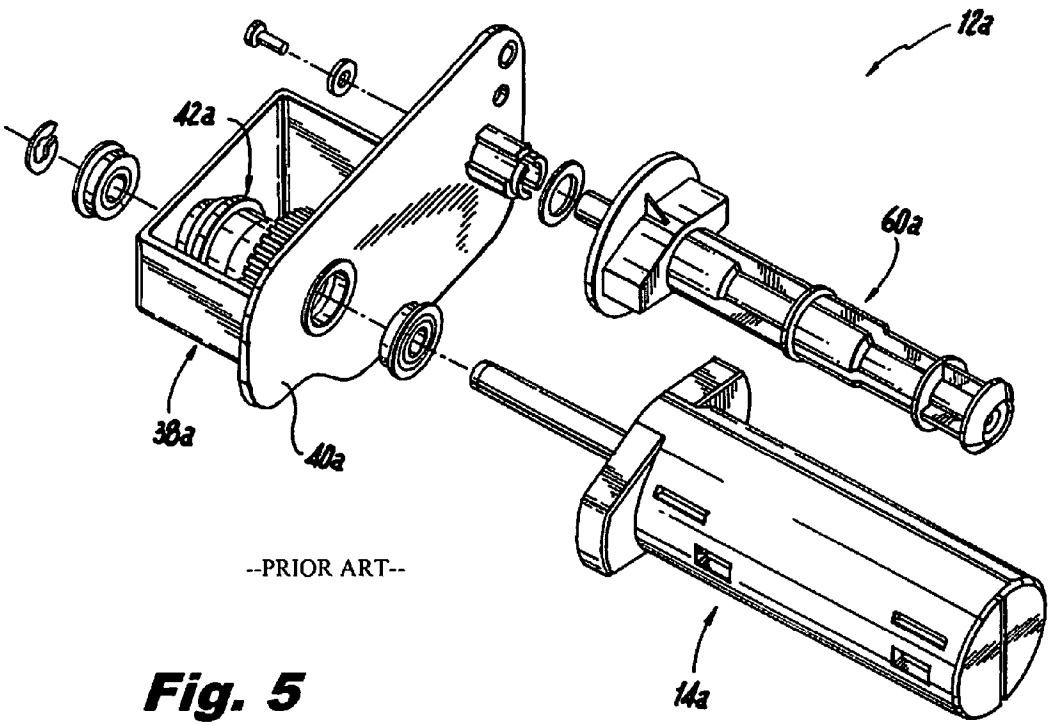
FIG. 5 is a perspective view of the ribbon take-up assembly of the modular printer shown in FIG. 1 when the printer is operated as an ink ribbon printer.

Referring to FIG. 5, where printer 10 is operated as an ink ribbon printer, a second media take-up assembly 12*a* is provided which in addition to hub assembly 14*a*, housing 38*a* including baseplate 40*a*, and media clutch assembly 42*a*, includes a ribbon supply assembly 60*a*. Ribbon supply assembly 60*a* is also secured to baseplate 38*a* such that the media take-up assembly 14*a* forms an integral unit or module.

Figure 6:
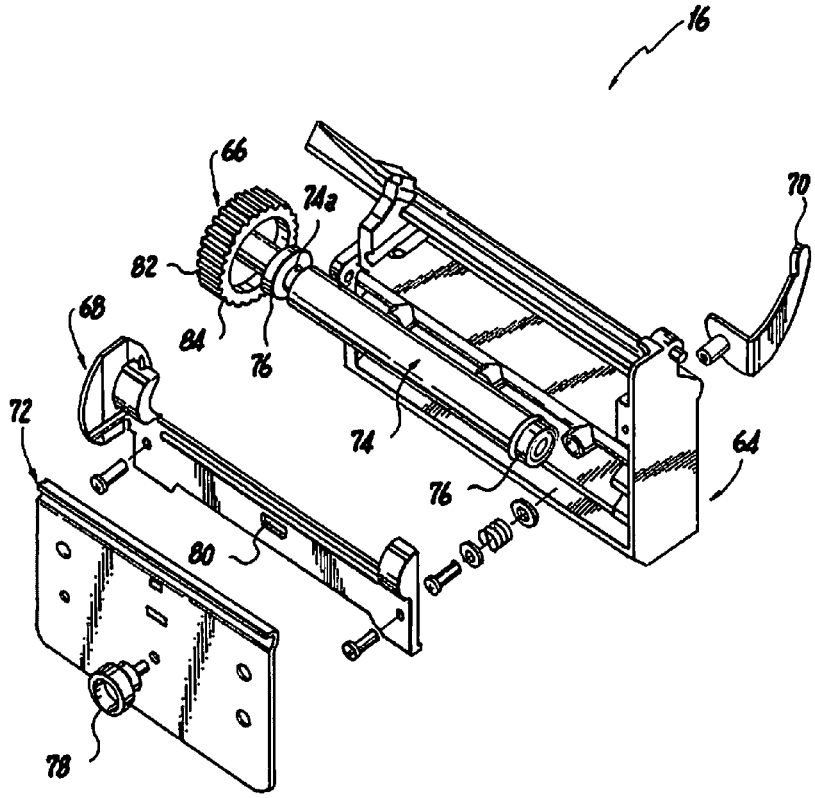
FIG. 6 is a perspective view, with parts separated, of the support block assembly of the modular printer shown in FIG. 1.

Referring to FIGS. 1 and 6, support block assembly 16 includes platen mounting block 64, a platen assembly 66, a retainer bracket 68, a media guide 70, and a tear bar 72. Platen assembly 66 includes platen 74 having a shaft 74*a* rotatably supported on mounting block 64. A flanged bearing 76 is secured to each end of the platen shaft 74*a*. The bearings 76 are positioned within recesses (not shown) formed in mounting block 64 to facilitate rotation of platen 74 relative to mounting block 64. A pair of driven gears 82 and 84 are secured to one end of the platen shaft 74*a* and are independently engageable by a drive gear (which will be discussed below) to drive the platen 74. Retainer bracket 68 is secured to mounting block 64 via a pair of screws to retain bearings 76 within the recesses of mounting block 64. Tear bar 72 is secured to mounting block 64 by a screw 78 which extends through an opening 80 defined by retainer bracket 68.

It is noted that in printers found in the prior art, removal of a damaged platen is a difficult, time-consuming procedure. In contrast, all that is required to remove platen 74 from support block assembly 16 is to unscrew screw 78 from mounting block 64 to remove tear bar 72 from assembly 16, and to remove the two screws securing retainer bracket 68 to mounting block 64. Platen 68 can now be lifted from mounting block 64.

As discussed above with respect to media take-up assembly 12, the entire support block assembly 16 forms an integral unit or module which is secured within a relief 82 (FIG. 1) formed in support housing 34. Support block assembly or module 16 can be easily and quickly removed and/or installed by removing or inserting a pair of screws (not shown) which extend between mounting block 64 and support housing 34. Mounting block 64 also includes an alignment protrusion (not shown) configured to be received within an alignment port formed in support housing 34 to ensure proper positioning of support block assembly or module 16 in relation to support housing 34.

Figure 7:
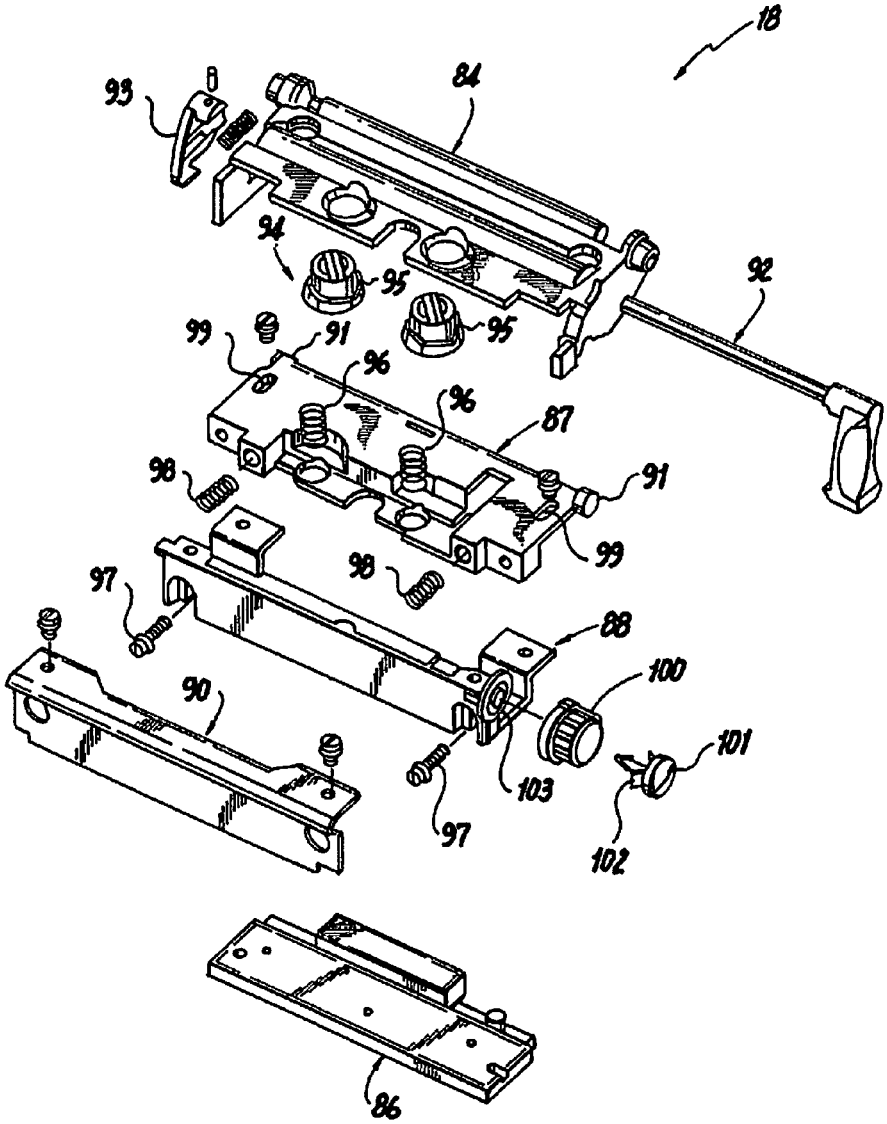
FIG. 7 is a perspective view, with parts separated, of the printhead assembly of the modular printer shown in FIG. 1.

Referring to FIG. 7, printhead assembly 18 includes a printhead mount 88, a printhead 86, a printhead adjustment bracket 87, and a ribbon shield 90. Printhead 86 includes a pair of pivot members 91, which are pivotably secured to printhead pivot 84. A latch assembly including latch members 92 and 93 is supported on printhead pivot 84 and is movable into a position to retain printhead 86 and printhead assembly 18 in fixed rotatable relation. A rotatable knob 94 having a cam surface 95 formed thereon is supported on each side of printhead 86. The cam surface 95 of each knob 94 is urged into engagement with printhead mount 84 by a spring 96. Both knobs 94 are selectively rotatable to urge printhead 86 away from printhead mount 84 to control printhead pressure of the printhead 86.

Printhead adjustment bracket 88 is secured to printhead adjustment bracket 87 by screws 97 which are positioned within slots 99 formed in printhead adjustment bracket 87. A pair of springs 98 is positioned between bracket 88 and printhead adjustment bracket 87 to urge bracket 88 away from printhead adjustment bracket 87. An adjustment knob 100 having a cam surface positioned to engage printhead 86 is rotatably secured to bracket 88 by a fastener 101 having a biasing member 102 formed therewith. Adjustment knob 100 includes a protrusion (not shown) which is urged into engagement with an annular array of detents 103 by fastener 101. Adjustment knob 100 is rotatable to selectively cam bracket 88 towards printhead 86 against the bias of springs 96. The adjustment knob protrusion and the annular array of detents 103 function to retain the bracket 88 and printhead 86 at fixed positions in relation to each other as determined by the rotational position of adjustment knob 100. The printhead assembly 18 forms an integral unit or module which is bolted to support housing 34 (FIG. 1) to secure the assembly within the printer.

Figure 8:
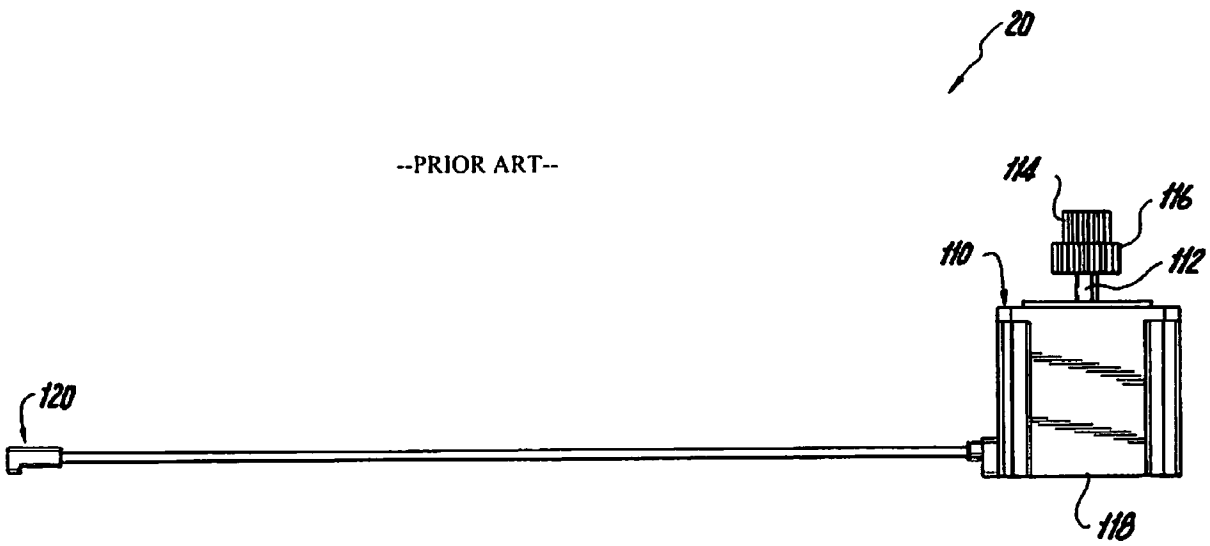
FIG. 8 is a top view of the stepper motor assembly of the modular printer shown in FIG. 1.

Referring to FIG. 8, stepper motor assembly 20 includes a stepper motor 110 having an output shaft 112 and a pair of gears 114 and 116 secured to output shaft 112. Stepper motor 110 is supported within a housing 118. A connector 120 having a contact pin (not shown) extends from housing 118 to facilitate connection of the stepper motor 110 to a power source. Stepper motor assembly 20 forms an integral unit or module.

Referring again to FIG. 2, cast 34 includes first and second mounting locations 122 and 124 configured to receive motor assembly 20. Motor assembly 20 can be secured at either location to selectively position either one of gears 112 or 114 into meshing engagement with one of platen assembly gears 82 or 84 (See FIG. 6). This double gear multi-location mounting arrangement provides for a printer which is capable of changing speed simply by changing the location of the stepper motor on support housing 34. Moreover, since only four screws need be removed, this process can be performed easily and quickly.

Referring again to FIG. 1, printer assembly 10 also includes a media supply hub assembly 130 which includes a hub 132 and an adjustable retaining member 134. Hub 132 includes an elongated slot 138 formed in each side thereof. Adjustable retaining member 134 includes a body 140 having a pair of legs 142. Each leg 142 has a distal end portion (not shown) which is configured to be slidably received in elongated slot 138.

FIGS. 9-21 illustrate another embodiment of the presently disclosed printer or print engine shown generally as 200. Printer 200 includes many of the modular features discussed above with respect to printer 10. Printer 200 offers both direct thermal printing and thermal transfer printing capabilities. Direct thermal printing uses specially treated label stock which contains dyes that turn black upon application of heat and pressure. Thermal transfer printing requires the use of a ribbon substrate having ink which is transferred onto a media upon application of heat and/or pressure to the ribbon substrate.

Figure 9:
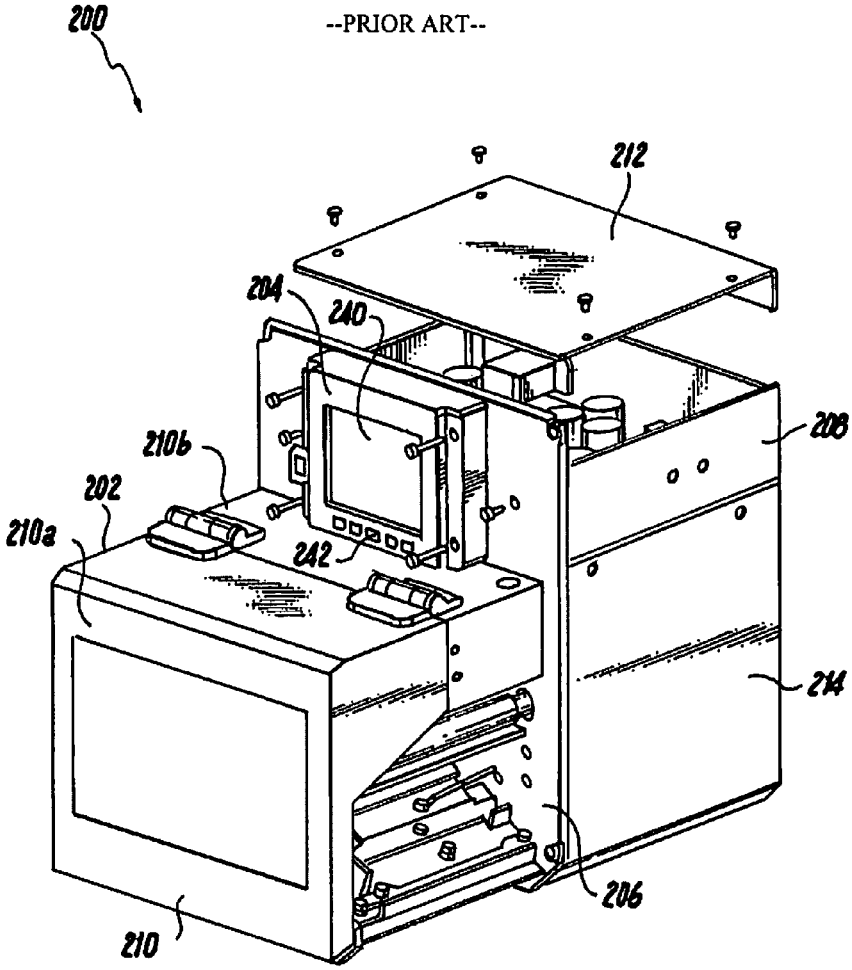
FIG. 9 is a perspective view of yet another embodiment of the presently disclosed modular printer.
Figure 10:
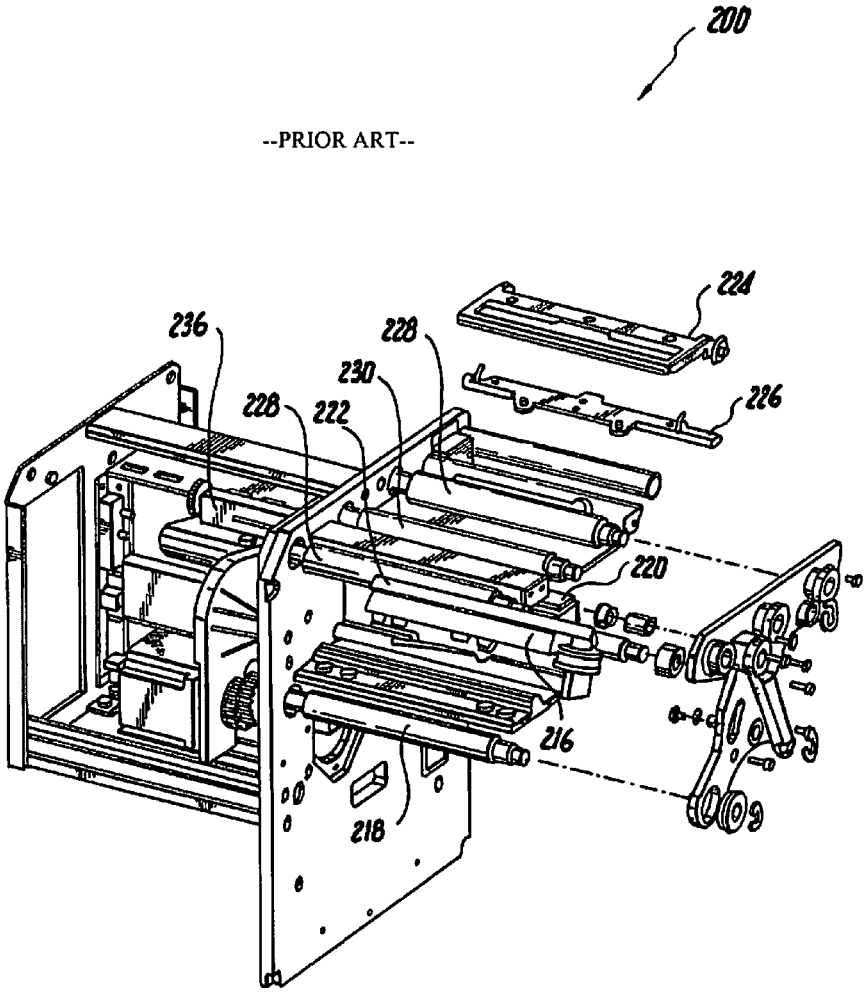
FIG. 10 is a bottom, side perspective view of the modular printer shown in FIG. 9 with the entire cover removed and the ribbon supply module and ribbon take-up module removed.
Figure 11:
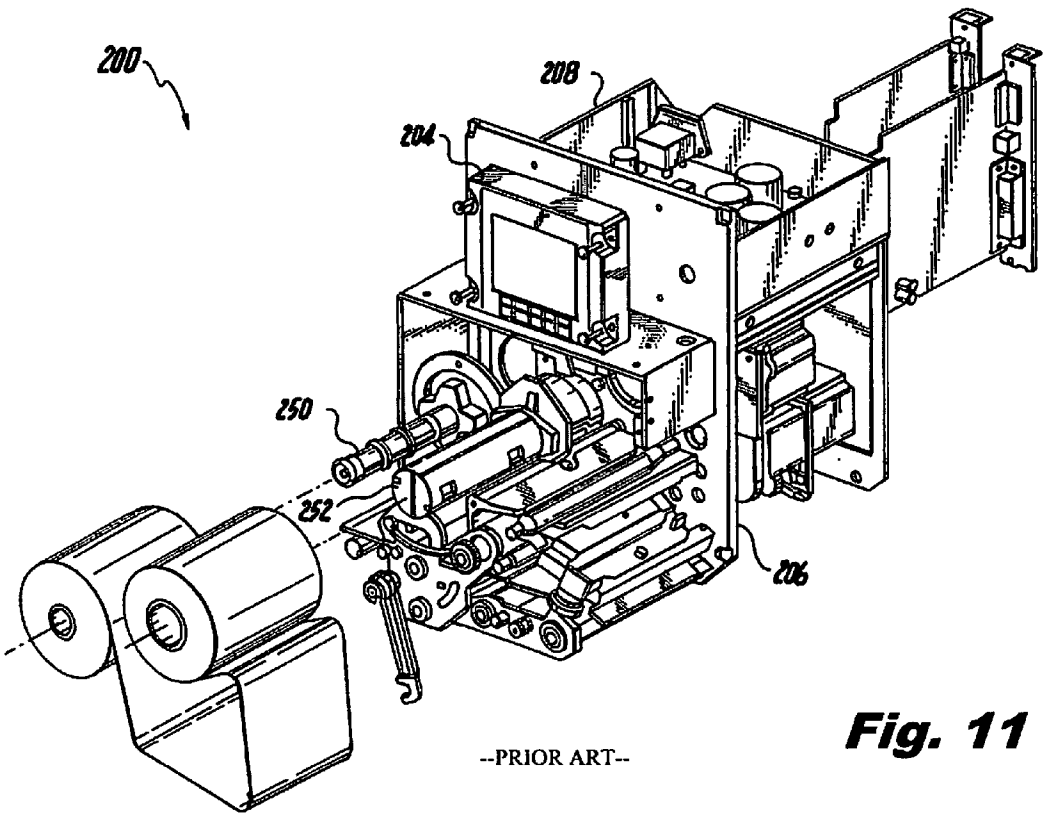
FIG. 11 is a top, front perspective view of the modular printer shown in FIG. 9 with a portion of the cover removed and a roll of ribbon and a pair of circuit boards separated therefrom.
Figure 12:
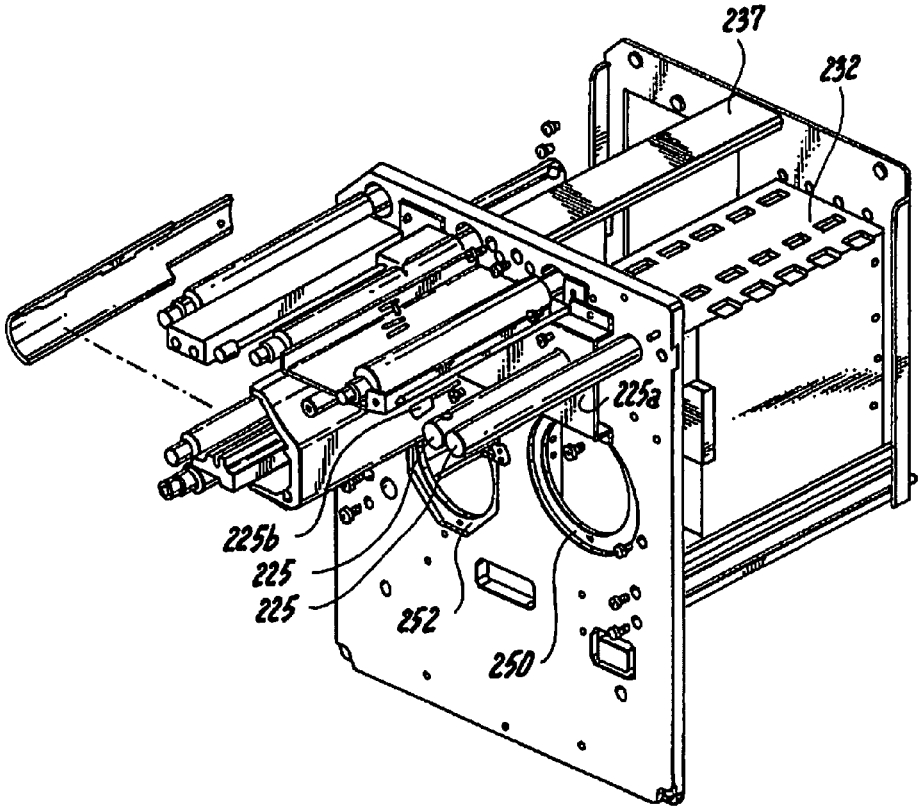
FIG. 12 is a bottom, opposite side perspective view of the modular printer shown in FIG. 10.
Figure 13:
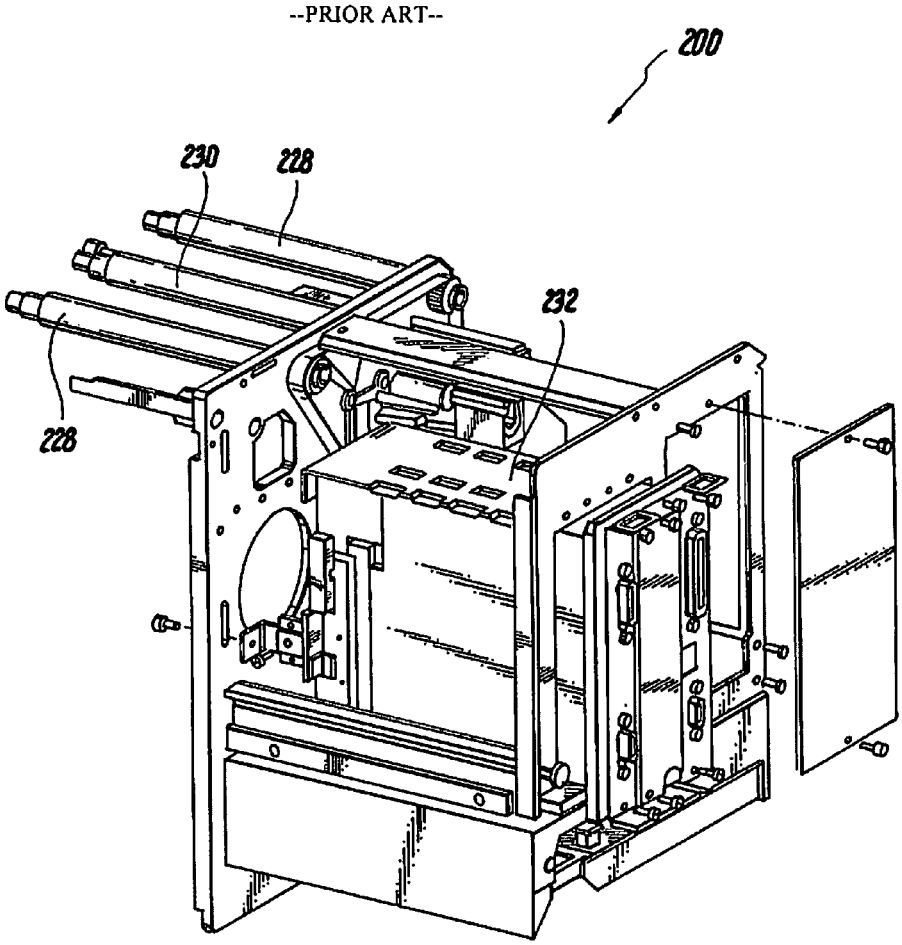
FIG. 13 is a rear perspective view of the modular printer shown in FIG. 12 with the power supply module attached to the centerplate.
Figure 14:
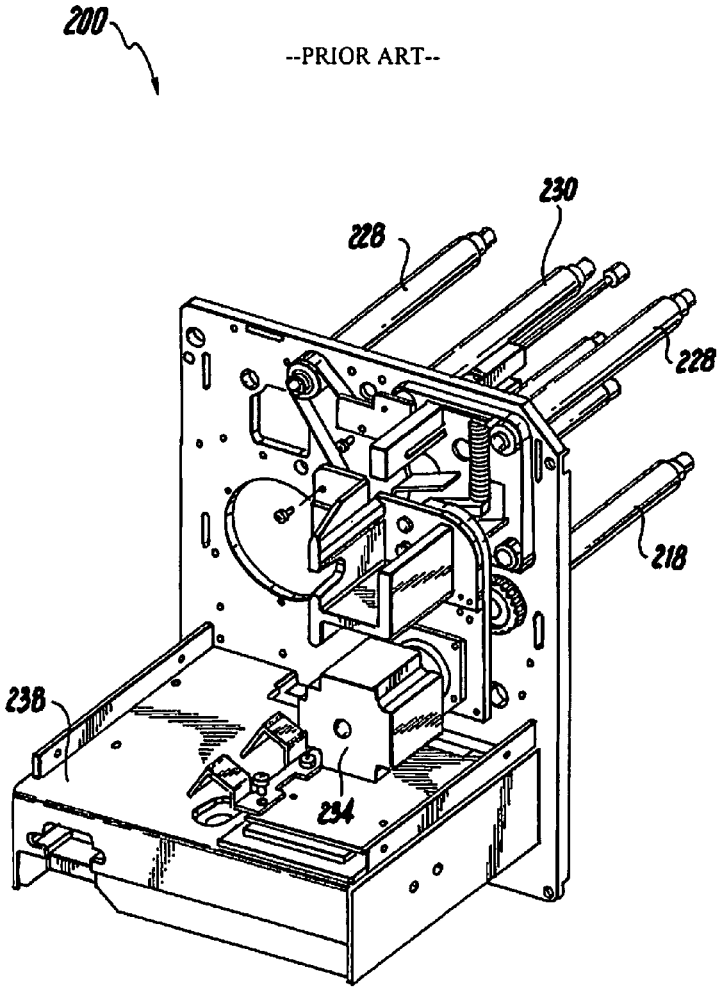
FIG. 14 is a rear, bottom perspective view of the modular printer shown in FIG. 9 with the card cage assembly removed.

Referring to FIG. 9, printer 200 includes a cover assembly 202, a display assembly 204, a centerplate 206 and a power supply assembly or module 208. Cover assembly 202 includes a front cover 210 having an outer cover 210*a* and an inner cover 210*b*, a top cover 212 and a rear cover 214. Outer cover 210*a* is hingedly secured to inner cover 210*b* to facilitate easy access to the internal components of printer 200. Centerplate 206 defines an internal support wall of printer 200 and may be formed of a material having good heat transfer characteristics, e.g., aluminum. The electronics and drive mechanisms are supported on one side of the centerplate 206 and the printer components are supported on an opposite side or media side of centerplate 206 as will be discussed in further detail below.

Referring to FIGS. 10-14, the media side of printer 200 includes a printhead assembly 216, a take-up roller assembly 218, a ribbon idler shaft 220, a peel bar 222, a pinch roller assembly 224, media posts 225, a media guide plate 225*a*, an adjustable media guide 225*b*, a latch assembly 226, a main platen roller assembly 228, and a peel plate roller assembly 230. The electronics side of printer 200 includes power supply assembly 208, a card cage assembly 232, stepper motor assembly 234 and a media sensor assembly 236. A rear support block 237 provides additional structural support to printer 200. Power supply assembly 208 is modular in construction and is supported on a support plate 238. The modular construction of power supply assembly 208 facilitates easy assembly and maintenance of printer 200. Card cage assembly 232 is configured to slidably receive the main logic card of printer 200 and applicator cards (not shown), as well as optimal electronic interface cards. Card cage assembly 232 includes printed wiring assemblies. Cage assembly 232 allows for field upgrades of printer 200 and easy servicing and maintenance.

Referring again to FIG. 9, a display assembly 204 is supported on the media side of centerplate 206. Display assembly 204 may include an electronic liquid crystal graphics display 240. Display assembly 204 may be rotatably mounted on printer 200 to allow for easy reading of display 240 when printer 200 is mounted upside down. The display assembly 204 identifies the status of printer 200 and includes operational and menu keys 242 which allow an operator to change parameters of printer 200 that control operation of the printer. The display 240 may be capable of displaying commands and the parameters of operation in multiple languages.

With continued reference to FIG. 9, in use of printer 200, a label stock is drawn by main platen roller 228 from a supply roll located externally of printer 200 through a media sensor of media sensor assembly 236 under a thermal printhead of printhead assembly 216. The media sensor (not shown) senses the presence of label stock by sensing a top edge of a label or indicia on a bottom surface of a label which coincides with a top edge of the label. Once the edge of the label is detected, printer 200 is capable of shifting the print location to print on any desired portion of the label. When the label is passed under the thermal printhead, the printhead heats the thermally sensitive label or ribbon positioned adjacent the label to form small black dots on the label. The small dots are grouped to form characters, bar codes or graphic images. By having graphics printing capabilities, printer 200 is able to print an unlimited number of characters and, thus, can print in a variety of different languages including Chinese, Korean, Russian and Arabic. Printer 200 is also capable of printing an unlimited number of graphics including corporate logos, graphs and/or charts and an infinite variety of different symbols.

After an image is processed on the label, the label stock including a liner and label is moved past the thermal printhead and wrapped over peel bar 222 (FIG. 10) and against an overdriven roller of peel plate roller assembly 230. The overdriven roller forces a tight bend in the label stock and creates high shear stresses to form between the label and the liner. As a result of the high stresses, the label separates from the liner and is fed out of the front of the printer. The liner is fed to the rear of the media side of printer 200.

As discussed above, printer 200 is configured to accommodate easy to install modular assemblies similar to those disclosed above with respect to printer 10.

Figure 15:
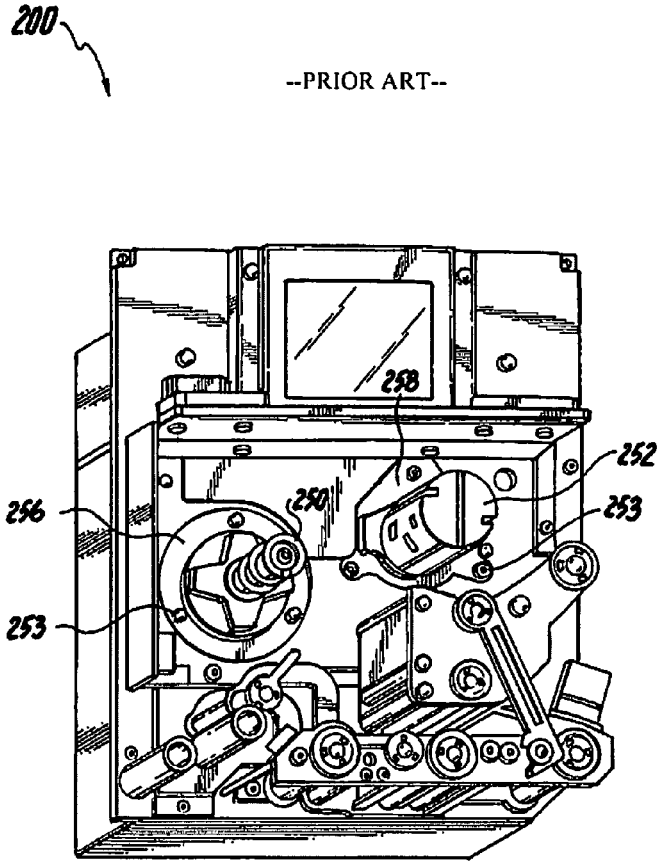
FIG. 15 is a front perspective view of the modular printer shown in FIG. 9 with the front cover removed.

Referring to FIG. 15, when printer 200 functions as a thermal transfer printing apparatus, a ribbon supply assembly or module 250 and a ribbon take-up assembly or module 252 are installed into printer 200. Recesses 256 and 258 are provided in centerplate 206 to receive and accurately position the ribbon supply and take-up modules within the media side of printer 200. One or more screws 253 may be used to secure the modules to centerplate 206.

Referring to FIGS. 16 and 17, ribbon supply assembly 250 includes a hub assembly 259 including, a ribbon supply shaft 260, a plurality of hub portions 262, independently rotatably positioned about shaft 260, a plurality of torsion springs 264 positioned between adjacent hub portions 262, and a ribbon support housing 266. Each torsion spring 264 includes a bend 268*a* and 268*b* formed at each end thereof. Bend 268*a* is positioned to non-rotatably engage ribbon supply shaft 260 and bend 268*b* is positioned to non-rotatably engage a respective hub portion 262.

In use, a spool of ribbon is positioned about hub assembly 259 and is in contact with hub portions 262. Ribbon take-up assembly includes a hub (not shown) which is driven by the drive mechanism of printer 200 to unwind ribbon from the spool of ribbon positioned on hub assembly 259 of ribbon supply assembly 250. As ribbon is unwound from hub assembly 259, torque from the spool of ribbon is translated from the spool of ribbon, through hub portions 262 and torsion springs 264 to ribbon supply shaft 260. As a result, a back tension is created in the ribbon as each torsion spring is put in torque. Because the hub portions are independently rotatable about shaft 260, the amount of back tension is created in the ribbon is proportional to the width of the spool of ribbon. More specifically, if a spool of ribbon has a width equal to the length of two hub portions 262, only the torsion springs associated with the two hub portions in contact with the spool of ribbon will provide back-tension in the ribbon. As the width of the ribbon increases, additional hub portions 262 are engaged by the spool of ribbon and, thus, the additional torsion springs contribute to the back tension in the ribbon.

Referring again to FIG. 16, a sensor may be provided in the ribbon supply assembly to indicate whether the ribbon supply assembly 250 is rotating and how much ribbon is remaining in ribbon supply assembly 250. In one embodiment, an electronic sensor 272, e.g., laser or infrared sensor, is positioned in a ribbon support housing 266 of the ribbon supply assembly and a sensor label 276 is secured on an inner hub portion 262*a* of hub assembly 259. Electronic sensor 272 is connected to the electronic circuitry of printer 200 and is positioned to recognize when hub assembly 259 is rotating and ribbon is being unwound. In embodiments, indicia is provided on the sensor label 276 which is read by the sensor 272 as sensor label 276 rotates with hub assembly 259. For example, lamp black and silver stripes may be provided on sensor label 276. As the spool of ribbon unwinds at a particular rate, the speed of rotation of hub shaft 259 increases as the diameter of the ribbon spool decreases. Sensor 276 registers the speed of the hub assembly to provide an indication of how much ribbon is remaining on the spool. Alternately, different colors and/or indicia and/or sensor mechanisms may be provided.

Printer engine 200 is similar in construction to modular printer 10 in that printer 200 includes a central support member 206 having printer modules supported on a first side of support member 206 and the electrical and drive components secured to an opposite side of support member 206. In addition to those components disclosed above, printer 200 includes at least two additional driven rollers to independently control movement of the media and ribbon within the printer. The rollers may be independently driven or driven by a common on driver. The driven rollers include a drive roller or hub 228 for controlling movement of media and a second drive roller 232 for controlling movement of ribbon. Because drives are provided for the media and the ribbon, the ribbon need not be continuously driven through the printhead assembly with the media, but rather need only be driven through the printhead assembly when actual printing onto the media is occurring. As a result, a substantial reduction in the quantity of ribbon required to operate the printer is achieved. Software or control circuitry is provided to coordinate operation of the ink ribbon drive, roller with operation of the printhead assembly.

Figure 18:
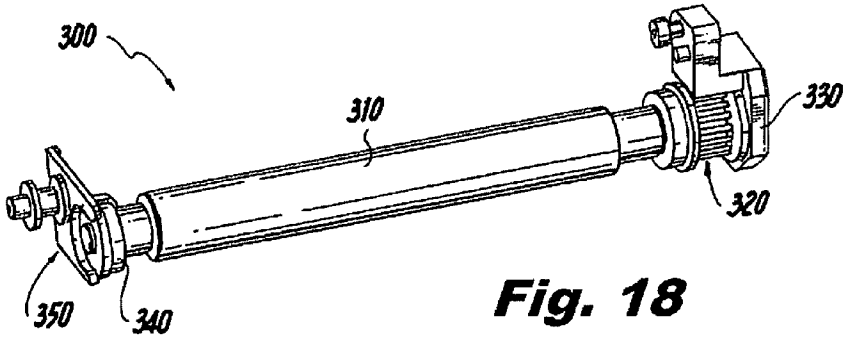
FIG. 18 is a perspective view of one embodiment of a platen roller assembly in accordance with the present disclosure.
Figure 21:
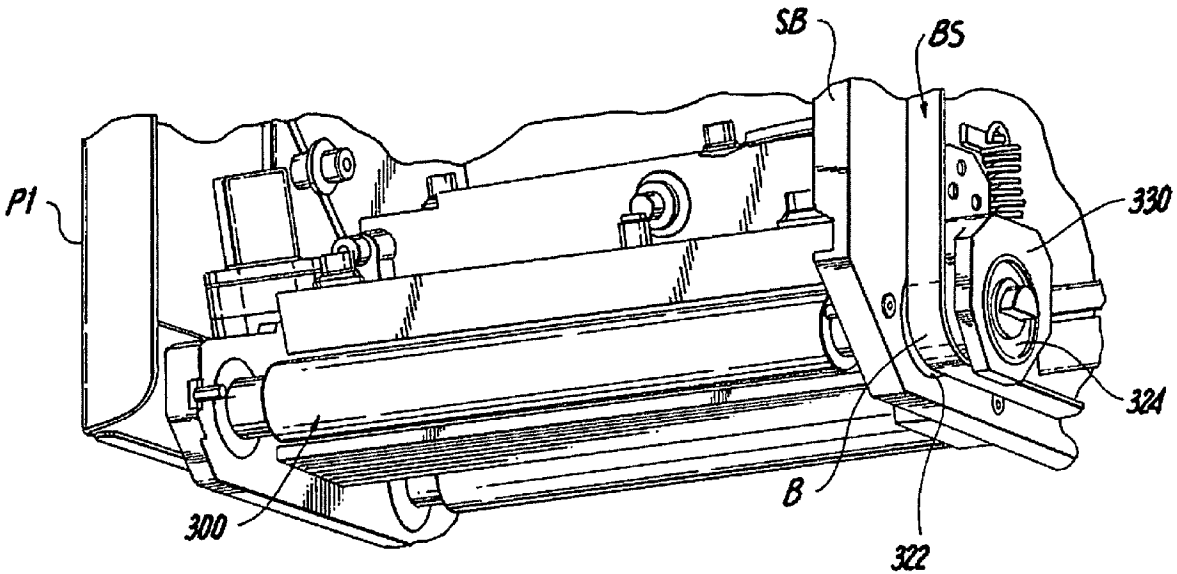
FIG. 21 is a perspective view of the platen roller assembly of FIGS. 18 and 19 supported by one embodiment of a printer.
Figure 22:
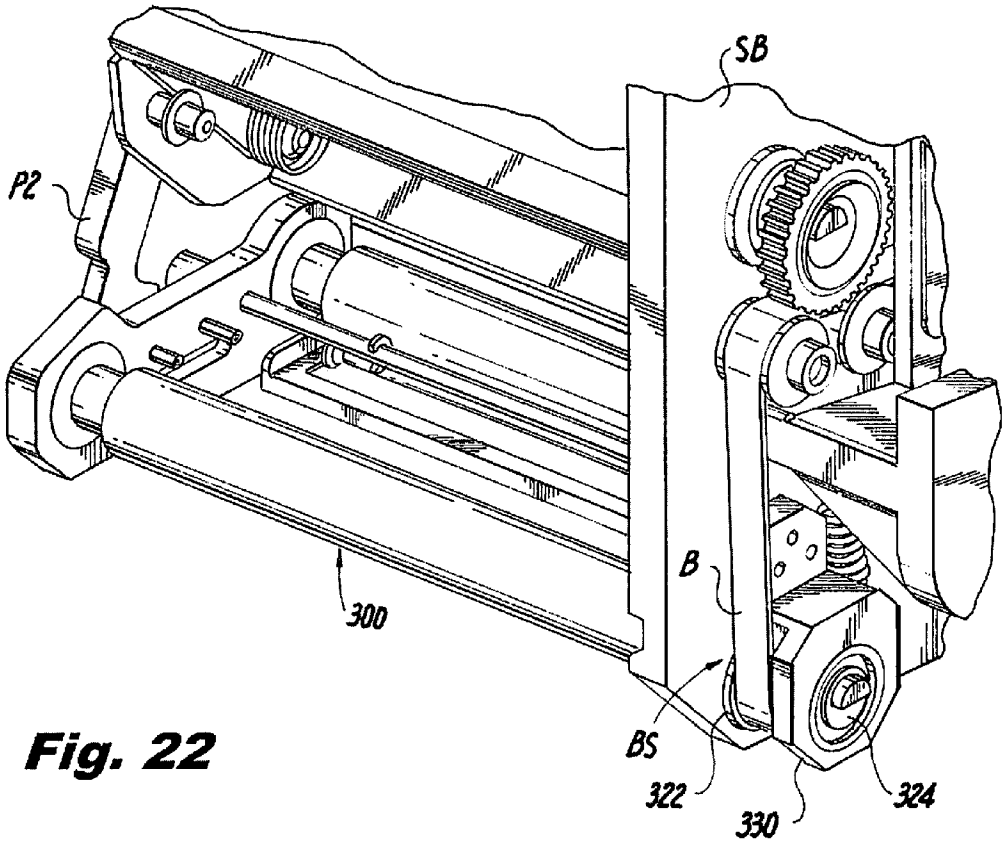
FIG. 22 is a perspective view of the platen roller assembly of FIGS. 18 and 19 supported by to another embodiment of a printer.

As illustrated in FIG. 18, one embodiment of at platen roller assembly 300 includes a platen roller 310, a pulley gear assembly 320, a mounting bracket 330, a proximal bearing 340, and a clip assembly 350. As illustrated in FIGS. 21-22, the platen roller assembly 300 may be mounted to a support body "SB" of as printer 10, 200, "P1" or "P2."

Figure 19:
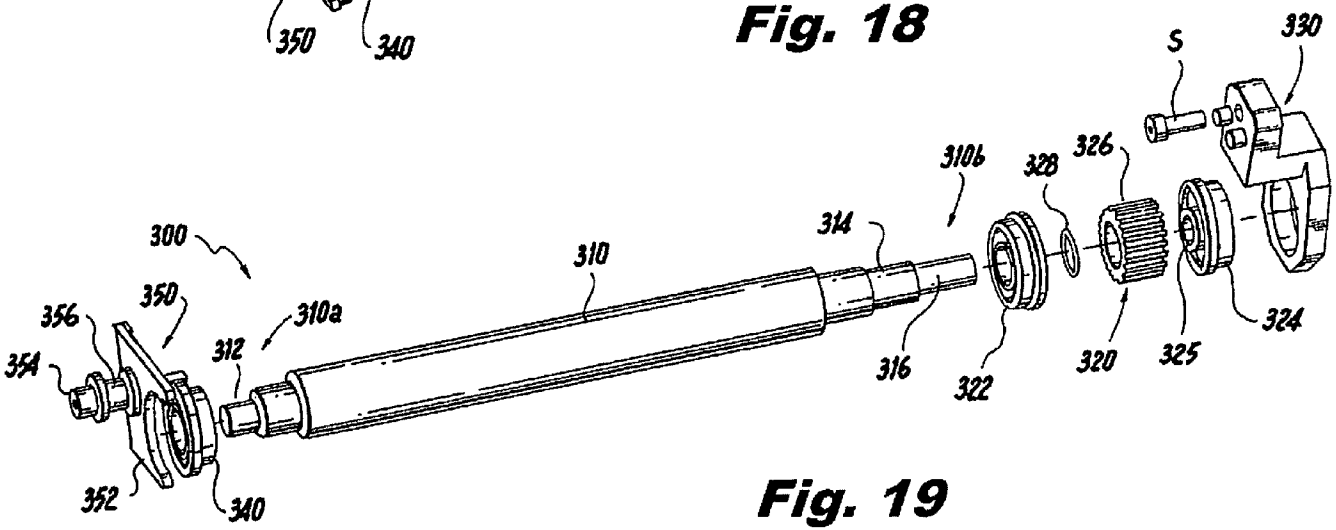
FIG. 19 is an exploded perspective view, with parts separated, of the platen roller assembly of FIG. 18.

Referring now to FIG. 19, the platen roller 310 is a generally elongate member having proximal and distal ends 310*a*, 310*b*. The proximal end 310*a* has one or more proximal shoulders 312 configured and adapted to engage the proximal bearing 340. The distal end 310*b* includes a distal shoulder 314 and a D-shaped extension 316 configured and adapted to engage the pulley gear assembly 320.

Figure 20:
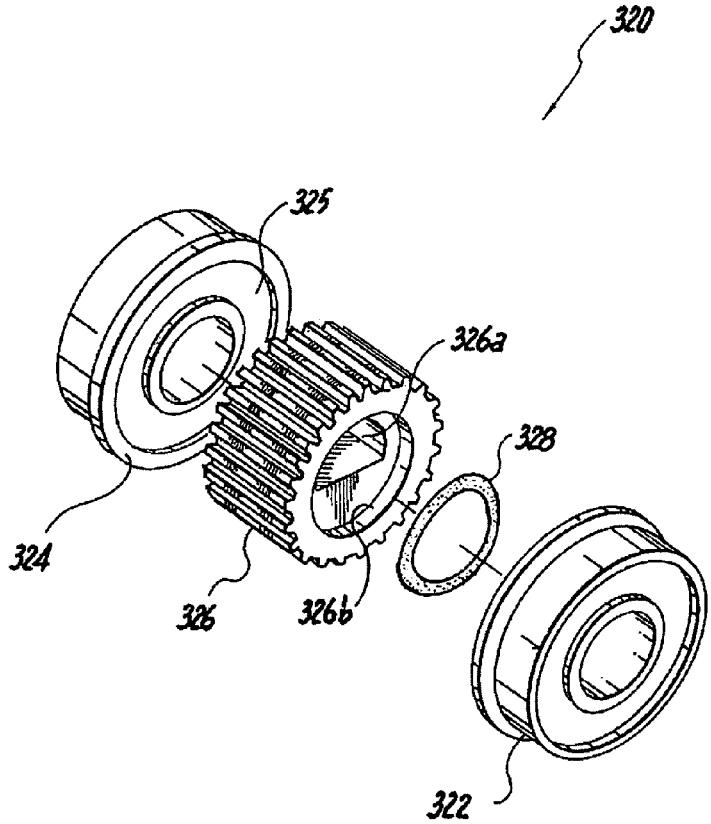
FIG. 20 is an exploded perspective view, with parts separated, illustrating a pulley gear assembly of the platen roller assembly of FIGS. 18 and 19.

Referring now to FIGS. 20-22, the pulley gear assembly 320 includes first and second distal bearings 322, 324 and a pulley gear 326 that is operably coupled to a belt "B." As illustrated in FIG. 20, the pulley gear 326 is operably associated with the first and second distal bearings 322, 324. The pulley gear 326 defines a substantially D-cut channel 326*a* (FIG. 20) therethrough for engaging the substantially D-shaped extension 316 of the platen roller 310. The D-cut channel 326*a* and the D-shaped extension 316 operably engage such that each of the bearings 340, 322, 324 permits rotational movement of the platen roller 310 about the longitudinal axis thereof in response to the rotational movement of the pulley gear 326 (which is driven by the belt "B"). A gasket 328 may be disposed in mechanical cooperation with the first and/or second distal bearings 322, 324 and the pulley gear 326. The first and second distal bearings 322, 324 each have an inner ring 325 (not shown in FIG. 20 on bearing 322) adapted to engage one or more recesses 326*b* (FIG. 20) defined within the pulley gear 326. In particular, mirrored recesses 326*b* may be defined on opposite sides of the pulley gear 326 for engaging each inner ring 325 inwardly extending from the surface of each bearing 322, 324. The inner ring 325 can extend between about 0.070 inches to about 0.120 inches from the surface of the bearing. With reference to FIGS. 18-19 and 21-22, the second distal bearing 324 is operably coupled to mounting bracket 330 which may be mounted to one or more printers, e.g. printers 10, 200, "P1" or "P2", via one or more screws "SB" (FIG. 19). From FIGS. 21-22, the mounting bracket 330 is configured and adapted to maintain the pulley gear 326 and the first and second distal bearings 322, 324 mounted to the support body "SB." The mounting bracket 330 enables the belt "B" to remain tensioned to the pulley gear 326 even when the platen roller 310 is disengaged therefrom. In this respect, the platen roller 310 may be selectively coupled and uncoupled to/from the support body "SB" independent of the pulley gear assembly 320.

With reference to FIGS. 18 and 19, the clip assembly 350 includes a clip 352 and a clip screw 354 having a latch post 356. The clip assembly 350 is disposed in mechanical cooperation with the proximal bearing 340 for maintaining the platen roller assembly 300 coupled to the support body "SB." In this manner, the clip 352 mounts to the support body "SB" via the clip screw 354 with the clip 352 being positioned to retain the platen roller 310 relative to the support body "SB."

In order to remove the platen roller 310 for replacement, repair or readjustment, the clip assembly 350 is removed by unscrewing the clip screw 354 and latch post 356, thereby releasing the clip 352, e.g., by any suitable mechanical tool (not shown) such as a wrench, pliers, screw driver, etc. In particular embodiments, a 3 mm Allen Wrench may be used. After removing the clip 352, the proximal bearing 340 is removed, freeing the platen roller 310. The platen roller 310 can then be withdrawn proximally through bearing holes defined within the support body "SB" of one of the printers, leaving the pulley gear 326 in situ to provide support for the belt "B" while the platen roller 310 is replaced. In other words, the pulley gear 326 is supported in place between the first and second distal bearings 322, 324. In this manner, the platen roller 310 can be removed without having to lose tension on a belt system "BS" of one of the printers, e.g., printers 10, 200, "P1" or "P2." Accordingly, this process avoids the lost time and effort that would result if there was lost tension in the belt "B" which would require readjustment of the belt tensioners of the belt system "BS", and, in many cases, would require removing additional components to access some of the various components of printers 10, 200, "P1" or "P2." A new platen roller may then be inserted. The proximal bearing 340 and the clip assembly 350 may then be reattached and tightened with the 3 mm alien wrench to about 5-6.5 ft-lbs. As such, maintenance is less cumbersome and quicker because full disassembly is not necessary.

Figure 23:
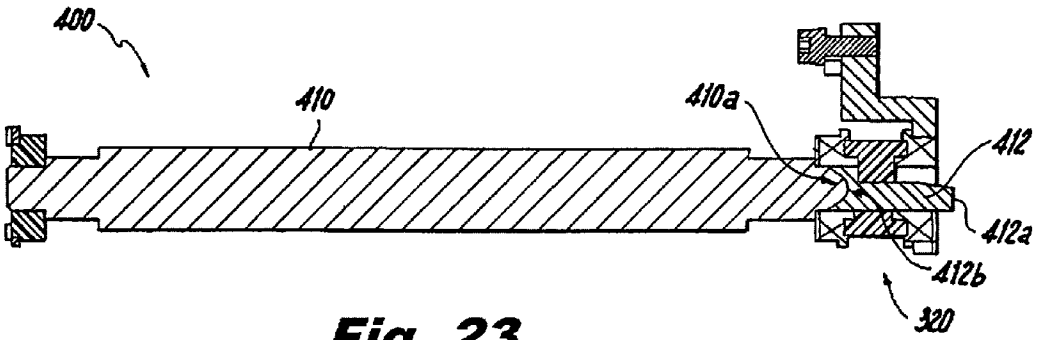
FIG. 23 is a side cross-sectional view of one embodiment of a platen roller assembly in accordance with the present disclosure.

As shown in FIG. 23, another embodiment of a platen roller assembly 400 includes a platen roller 410 that is disposed in mechanical cooperation with an extension 412. The platen roller 410 includes a distal end defining a first profile 410*a*. The extension 412 operably couples to the pulley gear assembly 320. The extension 412 defines a D-shape 412*a* at the distal end thereof and includes a proximal end defining a second profile 412*b*. The first and second profiles 410*a*, 412*b* have complimentary mating surfaces that operably engage. In this manner, rotational movement of the pulley gear assembly 320 rotates the extension 412 and the platen roller 410 when the complimentary mating surfaces of the first and second profiles 410*a*, 412*b* are in contact. When the platen roller 410 is removed, the extension 412 may remain engaged with the pulley gear assembly 320 or may be subsequently removed therefrom such that the platen roller 410 and the extension 412 are independently removable relative to each other and relative to the pulley gear assembly 320.

Figure 24:
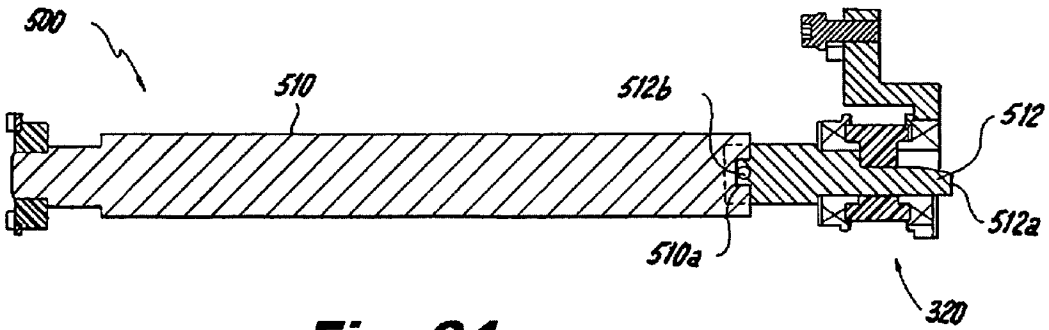
FIG. 24 is a side cross-sectional view of yet another embodiment of a platen roller assembly in accordance with the present disclosure.

As shown in FIG. 24, another embodiment of a platen roller assembly 500 includes a platen roller 510 that is disposed in mechanical cooperation with an extension 512. The platen roller 510 has a distal end that has a notch 510*a* defined therein. The extension 512 operably couples to the pulley gear assembly 320. The extension 512 defines a D-shape 512*a* at the distal end thereof and includes a pin 512*b* extending from the proximal end thereof transverse to the longitudinal axis thereof. The pin 512*b* operably couples with the notch 510*a* of the platen roller 510, which may be a locking engagement, such that rotational movement of the pulley gear assembly 320 rotates the extension 512 and the platen roller 510 when the pin 512*b* is in contact with the notch 510*a*. In embodiments, the notch 510*a* and the pin 512*b* are shaped to define any suitable locking arrangement, e.g., C-clip, cotter pin, etc., when they are operably coupled. When the platen roller 510 is removed, the extension 512 may remain engaged with the pulley gear assembly 320 or may be subsequently removed therefrom such that the platen roller 510 and the extension 512 are independently removable relative to each other and relative to the pulley gear assembly 320.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A platen roller assembly for a printer, comprising:

a platen roller defining a longitudinal axis;

a retaining clip that mounts to a support body of the printer and is positioned to retain the platen roller relative to the support body;

a plurality of bearings operably coupled to the platen roller, each of the bearings permitting rotational movement of the platen roller about the longitudinal axis thereof; and a pulley assembly mounted to the support body and operably associated with at least one of the beatings, the pulley assembly including a pulley and a belt, the belt being operably coupled to the pulley such that the platen roller rotates in response to rotational movement of the belt;

wherein the platen roller is selectively coupled and uncoupled to/from the support body independent of the pulley assembly;

wherein at least one of the plurality of bearings and the pulley assembly are operably associated with a mounting bracket that mounts the at least one bearing of the plurality of bearings and the pulley assembly to the support body of the printer independent of the platen roller.

2. The platen roller assembly according to claim 1, wherein at least one of the bearings includes a raised ring that operably couples to at least one recess defined within the pulley.

3. The platen roller assembly according to claim 2, wherein the raised ring extends between about 0.070 inches to about 0.120 inches from the surface of at least one of the bearings.

4. The platen roller assembly according to claim 1, further comprising a gasket disposed in mechanical cooperation with at least one of the bearings and the pulley.

5. The platen roller assembly according to claim 1, wherein a D-shaped extension extends from the platen roller and operably couples with a D-cut channel defined through the pulley.

6. The platen roller assembly according to claim 1, wherein the platen roller includes at least one shoulder formed to mechanically cooperate with at least one bearing.

7. The platen roller assembly according to claim 1, wherein the retaining clip is mounted to the support body via at least one screw.

8. The platen roller assembly according to claim 1, wherein the platen roller is disposed in mechanical cooperation with an extension that operably couples to the pulley assembly.

9. The platen roller assembly according to claim 8, wherein the platen roller and the extension include complimentary mating surfaces.

10. The platen roller assembly according to claim 8, wherein the platen roller defines a notch and the extension includes a pin extending therefrom, wherein the pin and the notch operably couple such that the platen roller is removably and lockingly engaged with the extension.

11. A printer, comprising:

a support body; and a platen roller assembly, comprising:

a platen roller defining a longitudinal axis;

a retaining clip that mounts to the support body and is positioned to retain the platen roller relative to the support body;

a plurality of bearings operably coupled to the platen roller, each of the beatings permitting rotational movement of the platen roller about the longitudinal axis thereof; and a pulley assembly mounted to the support body and operably associated with at least one of the bearings, the pulley assembly including a pulley and a belt, the belt remaining operably coupled to the pulley such that the platen roller rotates in response to rotational movement of the belt;

wherein the platen roller is selectively coupled and uncoupled to/from the support body independent of the pulley assembly;

wherein at least one of the plurality of bearings and the pulley assembly are operably associated with a mounting bracket that mounts the at least one bearing of the plurality of bearings and the pulley assembly to the support body independent of the platen roller.

12. The printer of claim 11, wherein a D-shaped extension extends from the platen roller and operably couples with a D-cut channel defined through the pulley.

13. The printer of claim 11, wherein the platen roller is disposed in mechanical cooperation with an extension that operably couples to the pulley assembly.

14. The printer of claim 13, wherein the platen roller and the extension include complimentary mating surfaces.

15. The printer of claim 13, wherein the platen roller defines a notch and the extension includes a pin extending therefrom, wherein the pin and the notch operably couple such that the platen roller is removably and lockingly engaged with the extension.

16. The printer of claim 11, further comprising a gasket disposed in mechanical cooperation with at least one of the bearings and the pulley.

* * * * *